United States Patent [19]

Kaye

[11] Patent Number: 4,791,828

[45] Date of Patent: Dec. 20, 1988

[54] CRANK HANDLE APPARATUS

[75] Inventor: Paul S. Kaye, Racine, Wis.

[73] Assignee: Lewisan Products, Inc., Racine, Wis.

[21] Appl. No.: 165,182

[22] Filed: Mar. 7, 1988

[51] Int. Cl.[4] ..... G05G 1/00

[52] U.S. Cl. ..... 74/545; 16/121; 403/165

[58] Field of Search ..... 74/545, 551.9, 558.5; 16/110, 121; 403/165, 78

[56] References Cited

U.S. PATENT DOCUMENTS

| | | | |
|---|---|---|---|
| 627,227 | 6/1899 | Fenton | 74/551.9 |
| 2,766,473 | 10/1956 | Thackara | 403/165 X |
| 4,052,768 | 10/1977 | Yamazaki et al. | 16/121 |
| 4,083,264 | 4/1978 | Klompenburg | 74/545 |
| 4,388,012 | 6/1983 | Erickson | 403/165 X |
| 4,534,240 | 8/1985 | Dietz et al. | 74/545 |

*Primary Examiner*—Peter A. Aschenbrenner
*Attorney, Agent, or Firm*—Peter N. Jansson, Ltd.

[57] ABSTRACT

An improved crank handle apparatus including a rod with radial protrusions near its distal end and a rotatable handle having a passageway receiving the rod, the passageway including a proximal portion with keyways therealong for protrusion passage during assembly, a middle retaining portion ending the keyways, and a distal portion of larger cross-section to accommodate the protrusions in any rotational position.

19 Claims, 1 Drawing Sheet

CRANK HANDLE APPARATUS

FIELD OF THE INVENTION

This invention is related generally to crank handle apparatus and, more particularly, to crank handles of the type having a handle member rotatably sleeved over a rod.

BACKGROUND OF THE INVENTION

Crank handles are among the oldest of simple mechanical devices, having been used for thousands of purposes over thousands of years. Such devices are used for turning something about a main axis. The crank handles themselves typically extend along an axis substantially parallel to and offset from the main axis.

Despite the antiquity of crank handles in general, improvements in crank handle apparatus continue to be made. And, there remains a need for improvement in crank handle construction.

Crank handles for inexpensive devices, such as drain-cleaning augers, have a number of drawbacks. First, in many cases crank handles for inexpensive devices include handle members which are non-rotatably affixed to the rod on which they are mounted. This has obvious drawbacks when it comes to ease of operation. Other crank handle apparatus for such inexpensive devices, while having rotatably mounted handles, are themselves somewhat costly in that three or more parts are included and a number of steps are required for assembly.

In some cases, a part as simple as a friction cap or nut (for example, what is known as a "pal nut") or some other kind of nut or attachment device is secured to the end of a rod protruding through a handle member. This is done to keep the handle from falling off the rod on which it is rotatably disposed. This sort of construction requires an assembly step which may be time-consuming and which, if carried out inaccurately as can often happen, leads to the need for later replacement.

Devices of this type, even when properly assembled, can have a tendency to require later replacement or service. This is particularly the case for devices which undergo much abuse during their normal use. A good example is drain-cleaning augers, the handles of which have substantial and irregular forces applied to them in various directions. This can loosen and knock a friction nut off the end of the rod to which it is attached.

A construction which eliminates the friction cap or nut often means losing rotatability of the handle on the rod, as previously noted. This is often unacceptable. There is a need for an improved, reliable, less-costly, easily assembled crank hand apparatus which is useful for inexpensive devices which undergo much abuse.

OBJECTS OF THE INVENTION

It is an object of this invention to provide an improved crank handle apparatus overcoming some of the problems and shortcomings of the prior art.

Another object of this invention is to provide an improved crank handle which has fewer parts and fewer assembly steps.

Another object of this invention is to provide an improved crank handle which can cost less than the most inexpensive crank handles yet has superior operating qualities.

Another object of this invention is to provide an improved crank handle which is simple in structure yet has handle rotatability and provides reliable operation.

Another object of this invention is to provide an improved crank handle having reduced susceptibility to breakdown during abuse and rarely or never requiring service.

These and other important objects will be apparent from the descriptions of this invention which follow.

SUMMARY OF THE INVENTION

This invention is an improved crank handle apparatus overcoming some of the problems and shortcomings of prior crank handles mentioned above. The crank handle of this invention is both very reliable and significantly less expensive than crank handles of the prior art of the type having rotatable handles sleeved over rods. The crank handle of this invention, like prior crank handles, is used for turning about a main axis.

The crank handle of this invention includes a rod which extends along an axis substantially parallel to the main axis from a proximal end to a distal end. The rod has a rod cross-section and protrusion means which are near the distal end and extend radially from the rod to beyond the rod cross-section. The invention also includes a handle which is rotatably mounted on the rod. The handle has an inner end near the rod proximal end, an outer end opposite the inner end, and a passageway which receives the rod.

The passageway in the handle includes, in series: a proximal portion; a middle retaining portion; and a distal portion. The proximal portion extends from the inner end and has keyway means therealong dimensioned to receive the protrusion means during assembly. The middle retaining portion has no such keyways and serves as the end(s) of the keyway(s) in the proximal portion. The distal portion has a cross-section which is larger in diameter than the cross-section of the middle portion such that the distal portion accommodates therein the protrusion means in any rotational position.

The handle preferably includes an axial tube which forms the proximal portion of the passageway. The tube has an annular void around it within the handle. The void extends to a position which is adjacent to the middle portion of the passageway.

In preferred embodiments, the protrusion means is a pair of protrusions, preferably flat coplanar protrusions which are along opposite sides of the rod. The keyway means is a pair of opposed grooves which are on opposite sides of the passageway proximal portion in the handle, such grooves accommodating the flat protrusions. The protrusions are preferably narrower, as viewed along the axis, than the rod cross-section. The protrusions are preferably integrally-formed with the rod by rod deformation.

In highly preferred embodiments of this invention, the outer end of the handle is well beyond the rod distal end. In this preferred configuration, the rod distal end is concealed well within the handle.

In certain highly preferred embodiments, the handle portion of the crank handle apparatus is in substantially fixed axial position with respect to the rod. The rod, between its proximal end and the protrusion means, is about equal in length to the combined axial lengths of the proximal and middle portions of the passageway. This serves to limit the range of relative axial movement of the handle and rod and thereby to minimize any possibility of removal of the handle from the rod.

In certain preferred embodiments of this invention, the passageway proximal portion, not considering the keyway(s), is substantially congruent to the cross-section of the passageway middle portion. Such cross-sections are both substantially congruent to the cross-section of the rod. All of such cross-sections are most preferably substantially circular.

The nature of the materials used for the handle and the rod are of some importance. Either the handle or the rod is resiliently deformable while the other member is much more rigid. These differences are such that the handle and rod may be sleeved together by a shock mounting process; the two parts fully mate either by a blow or by application of substantial axial pressure.

During such assembly, the protrusions from the rod pass along the grooves which form part of the proximal portion of the passageway. When they reach the passageway middle portion, the protrusions are stopped until the sufficient pressure is applied to allow completion of the assembly.

During the passage of the protrusions over the middle portion, the walls of the middle portion are temporarily deformed. The handle is made of a material having a resilient deformability which allows the wall of the middle portion to reassume its original round shape, or close to it. Thus, when the rod and handle are fully engaged, the wall of the middle portion serves a retention function. That is, the protrusions cannot easily pass over it, so the handle is retained in its axial position with respect to the rod.

This inability to pass back over the middle portion wall is due in part to the fact that there is little or no axial slack to allow axial momentum in a relative disengagement direction.

The handle is preferably made of resiliently deformable material, such as plastic, while the rod is preferably made of hard steel. Examples of acceptable materials are hereafter provided.

The invention eliminates the need for any connector parts of any kind. Permanent mounting of the handle on the rod is accomplished without any fastening or securing steps. Furthermore, the amount of rod material can be significantly reduced because the length of the rod necessary for proper mounting is significantly reduced.

DETAILED DESCRIPTIONS OF PREFERRED EMBODIMENTS

Figure 1:
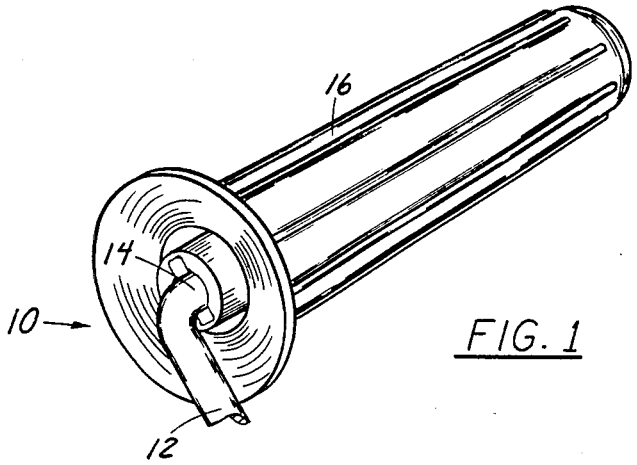
FIG. 1 is a perspective view of a crank handle in accordance with a preferred embodiment of this invention.
Figure 3:
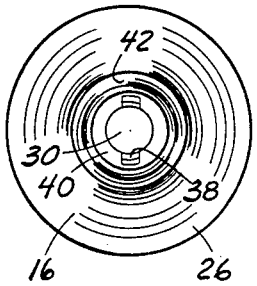
FIG. 3 is a left side elevation of FIG. 2, showing only the handle, the rod being excluded.
Figure 4:
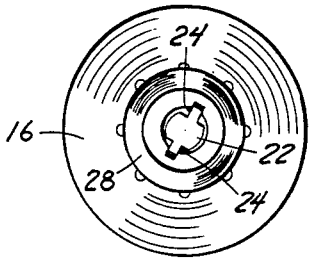
FIG. 4 is a right side elevation of FIG. 2.

The figures show a preferred improved crank handle 10 in accordance with this invention. Crank handle 10 includes a rod 12, with a handle-mounting rod portion 14, and a handle 16 rotatably mounted on rod portion 14. Crank handle 10, once assembled, is used for turning something about a main axis 18 (see FIG. 2) in the well-known manner of the prior art.

Rod portion 14 extends along an axis which is substantially parallel to main axis 18. Rod portion 14 extends from a proximal end 20 to a distal end 22. All of rod 12, including handle-mounting rod portion 14, is of solid round metal stock, with the rod cross-section being substantially constant at any point along its length, except as hereafter specifically described.

Rod portion 14 has protrusion means near distal end 22 which extend radially beyond the cross-section of rod portion 14. More specifically, a pair of axially parallel, axis-intersecting, coplanar protrusions 24 extend radially in mirror-image fashion from opposite sides of rod portion 14 near distal end 22. Protrusions 24 are planar and are narrower, when viewed along the axis, than the cross-section of rod portion 14.

Protrusions 24 are in the form of a pair of little wings extending from rod portion 14. Protrusions 24 are integrally-formed with rod portion 14 by deformation of rod portion 14. Such deformation may be carried out by an operation referred to "swaging."

Handle 16, which is rotatably mounted on rod portion 14, has an inner end 26 near proximal end 20 of rod portion 14 and an outer end 28 opposite inner end 26. Handle 16 also includes an axial passageway 30 through its entire length. Passageway 30 has three portions joined end-to-end in series, including a proximal portion 32, a middle retaining portion 34, and a distal portion 36. Rod portion 14 is received in passageway 30.

Proximal portion 32 of passageway 30 extends from inner end 26 to the beginning of middle retaining portion 34. Proximal portion 32 has a circular cross-section substantially equal in size to the cross-section of rod portion 14. Proximal portion 32 also has a pair of opposed axially-parallel grooves 38 which are dimensioned to receive protrusions 24 as handle 16 is assembled with rod 12. Grooves 38 form keyways facilitating the insertion of rod portion 14, including its protrusions 24.

Middle retaining portion 34 of passageway 30 is similar in cross-section to proximal portion 32, except that it has no grooves or other irregularities. Thus, middle retaining portion 34 provides ends for grooves 38. Middle retaining portion 34 has an axial dimension which is much smaller than the axial dimension of proximal portion 32. Indeed, the axial dimension of middle portion 34 is approximately equal to the diameter of rod portion 14, or slightly less than such diameter.

Distal portion 36 of passageway 30 also has a round cross-section, with no grooves or keyways of any kind therealong. However, the cross-section of distal portion 36 is substantially larger than the cross-section of middle portion 34. The cross-section of distal portion 36 is large enough to receive protrusions 24 in any rotational position. Thus, with rod portion 14 fully inserted into handle 16, as shown in FIG. 2, handle 16 is free to rotate on rod portion 16, as occurs during cranking operations.

Figure 2:
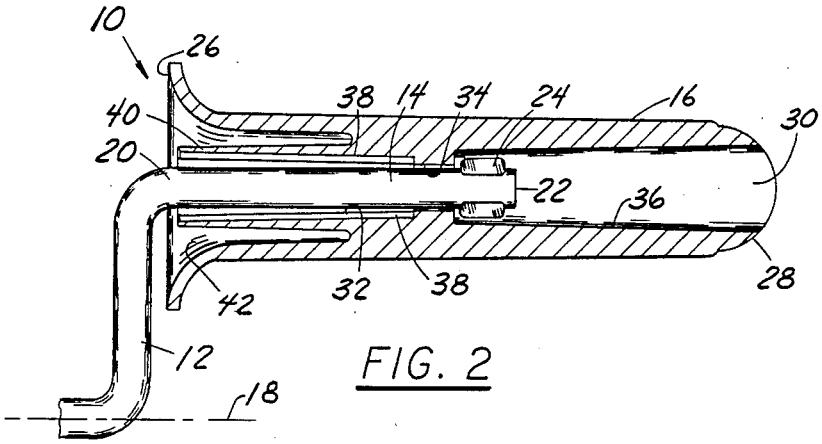
FIG. 2 is a side sectional view taken along the handle axis.

As illustrated best in FIG. 2, outer end 28 of handle 16 is well beyond distal end 22 of rod portion 14. Thus, distal end 22 of rod 12 is well inside handle 16 and is substantially concealed in handle 16.

Handle 16 is in a substantially fixed axial position with respect to rod portion 14. Rod portion 14, between its proximal end 20 and protrusions 24, is about equal in length to the combined axial lengths of proximal and middle portions 32 and 34 of passageway 30. Thus, handle 16 has very little axial play which might make its removal from rod portion 14 more likely. Once handle 16 has been assembled with rod portion 14, it remains permanently in place.

Handle 16 includes an axial tube 40 which is integrally formed with the remaining portions of handle 16. Axial tube 40 has an annular void 42 extending thereabout for the full length of proximal portion 2 of passageway 30. Void 42 extends to an axial position adjacent to middle portion 34. Such annular void 42 may in some cases somewhat facilitate the insertion of rod portion 14, with its protrusions 24, through proximal portion 32 of passageway 30 during assembly of handle 16 with rod 12. Annular void 42 also serves to save material and thus reduce cost.

Handle 16 is preferably made of a plastic material which is fairly hard, but not nearly as hard as rod portion 14. Rod portion 14 is preferably made of steel. Preferred materials for handle 16 include ultra-high molecular weight polyethylene, polypropylene copolymers, and nylon. Other suitable materials would be apparent to those skilled in the art who are familiar with this invention.

Handle 16 is assembled with rod portion 14 by first inserting rod portion 14 into proximal portion 32 of passageway 30, using grooves 38 for protrusions 24. Then rod portion 14 is hit or pressed hard so that protrusions 24 pass by middle retaining portion 32. This action causes a resilient deformation of middle portion 34 during such shock mounting. However, because of its resiliency characteristics, the wall of middle retaining portion 34 springs back at least to the extent that, when protrusions 24 are in distal portion 36 of passageway 30, middle retaining portion 34 will not pass over them.

The axial dimensioning described above makes it extremely difficult to jerk handle 16 from rod portion 14. Furthermore, the likelihood of properly aligning protrusions 24 with grooves 38 without good visual alignment is quite small. Thus, handle 16 remains in place, and handle 16 may freely rotate on rod portion 14.

While the principles of this invention have been described in connection with specific embodiments, it should be understood clearly that these descriptions are made only by way of example and are not intended to limit the scope of the invention.

I claim:

1. Crank handle apparatus for turning about a main axis comprising:

a rod extending along an axis substantially parallel to the main axis from a proximal end to a distal end, the rod of first cross-section and having protrusion means near the distal end which extend radially beyond the first cross-section;

a handle rotatably mounted on the rod with an inner end near the proximal end, an opposite outer end, and a passageway receiving the rod and including in series:

a proximal portion extending from the inner end having keyway means therealong dimensioned to receive the protrusion means during assembly, a middle retaining portion ending the keyway, and a distal portion of second cross-section larger than the middle portion to accommodate therein the protrusion means in any rotational position.

2. The crank handle apparatus of claim 1 wherein the protrusion means is a pair of protrusions along opposite sides of the rod and the keyway means is a pair of grooves.

3. The crank handle apparatus of claim 1 wherein the protrusion means is a pair of axially-parallel protrusions along opposite sides of the rod, the protrusions narrower than the first cross-section, and the keyway means is a pair of opposed grooves.

4. The crank handle apparatus of claim 3 wherein the protrusions are integrally-formed with the rod by rod deformation.

5. The crank handle apparatus of claim 1 wherein the handle outer end is beyond the rod distal end, whereby the distal end of the rod is concealed within the handle.

6. The crank handle apparatus of claim 5 wherein the protrusion means is a pair of axially-parallel protrusions along opposite sides of the rod, the protrusions narrower than the first cross-section, and the keyway means is a pair of opposed grooves.

7. The crank handle apparatus of claim 6 wherein the protrusions are integrally-formed with the rod by rod deformation.

8. The crank handle apparatus of claim 1 wherein the handle is in substantially fixed axial position with respect to the rod.

9. The crank handle apparatus of claim 8 wherein the rod, between the proximal end and the protrusion means, is about equal in length to the combined axial lengths of the proximal and middle portions of the passageway, whereby limiting the range of relative axial movement of the handle and rod and minimizing any possibility of removal of the handle from the rod.

10. The crank handle apparatus of claim 9 wherein the protrusion means is a pair of axially-parallel protrusions along opposite sides of the rod, the protrusions narrower than the first cross-section, and the keyway means is a pair of opposed grooves.

11. The crank handle apparatus of claim 10 wherein the protrusions are integrally-formed with the rod by rod deformation.

12. The crank handle apparatus of claim 1 wherein the cross-section of the passageway proximal portion, excluding the keyway, is substantially congruent to the cross-section of the passageway middle portion.

13. The crank handle apparatus of claim 12 wherein the cross-section of the passageway proximal portion, excluding the keyway, and the cross-section of the passageway middle portion are substantially congruent to the first cross-section.

14. The crank handle apparatus of claim 13 wherein all of the cross-sections are substantially circular.

15. The crank handle apparatus of claim 1 wherein at least one of the handle and rod is resiliently deformable to an extent allowing shock mounting of the handle on the rod.

16. The crank handle apparatus of claim 15 wherein the handle is made of a first material and the rod is made of a second material, the first material being resiliently deformable and the second material being more rigid than the first material.

17. The crank handle apparatus of claim 16 wherein the handle includes an axial tube forming the proximal portion of the passageway, the tube having an annular void thereabout within the handle extending to a position adjacent to the middle portion.

18. The crank handle apparatus of claim 17 wherein the protrusion means is a pair of axially-parallel protrusions along opposite sides of the rod, the protrusions narrower than the first cross-section, and the keyway means is a pair of opposed grooves.

19. The crank handle apparatus of claim 18 wherein the protrusions are integrally-formed with the rod by rod deformation.

* * * * *